US011015858B2

(12) United States Patent
Lee

(10) Patent No.: US 11,015,858 B2
(45) Date of Patent: May 25, 2021

(54) REFRIGERATOR AND COLD AIR FLOW RATE MONITORING SYSTEM THEREOF

(71) Applicant: LG ELECTRONICS INC., Seoul (KR)

(72) Inventor: Sunghun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 821 days.

(21) Appl. No.: 15/250,444

(22) Filed: Aug. 29, 2016

(65) Prior Publication Data

US 2017/0082347 A1 Mar. 23, 2017

(30) Foreign Application Priority Data

Sep. 21, 2015 (KR) ..... 10-2015-0133373

(51) Int. Cl.

| | |
|---|---|
| ***F25D 17/04*** | (2006.01) |
| ***F25D 11/02*** | (2006.01) |
| ***F25D 17/06*** | (2006.01) |
| ***F25D 25/02*** | (2006.01) |
| ***F25D 29/00*** | (2006.01) |

(52) U.S. Cl.

CPC ..... *F25D 17/045* (2013.01); *F25D 11/02* (2013.01); *F25D 17/065* (2013.01); *F25D 25/025* (2013.01); *F25D 29/005* (2013.01); *F25D 2317/061* (2013.01); *F25D 2317/0672* (2013.01); *F25D 2400/36* (2013.01); *F25D 2700/12* (2013.01); *F25D 2700/14* (2013.01)

(58) Field of Classification Search

CPC ..... F25D 17/045; F25D 17/065; F25D 11/02; F25D 25/025; F25D 29/005

See application file for complete search history.

(56) References Cited

U.S. PATENT DOCUMENTS 4,688,393 A * 8/1987 Linstromberg ..... F25D 17/045 62/180
5,490,395 A * 2/1996 Williams ..... F24F 13/12 62/187
5,524,447 A 6/1996 Shim (Continued)

FOREIGN PATENT DOCUMENTS

CN 1128569 A 8/1996
CN 1501043 A 6/2004

(Continued)

*Primary Examiner* — Gordon A Jones

(74) *Attorney, Agent, or Firm* — Dentons US LLP

(57) ABSTRACT

A refrigerator and a cold air flow rate monitoring system for the refrigerator, the refrigerator including a main body having a refrigerating chamber therein, a cold air passage duct disposed within the main body and provided with a cold air passage therein, a control case coupled to the cold air passage duct and provided with a cold air discharge opening, a knob installed on the control case and opening and closing at least part of the cold air discharge opening in a manner of reciprocally moving in one direction, and a sensing unit provided with a conductive member mounted on the knob and a circuit portion provided on the control case, and configured to sense relative position of the knob with respect to the control case to acquire information related to an opening and closing amount of the cold air discharge opening.

12 Claims, 12 Drawing Sheets

(56) References Cited

U.S. PATENT DOCUMENTS

| | | | | |
|---|---|---|---|---|
| 5,684,448 | A * | 11/1997 | Jacobsen | H01H 61/0107 337/123 |
| 5,816,061 | A * | 10/1998 | Lee | F24F 13/06 62/187 |
| 5,901,562 | A | 5/1999 | Tunzi et al. | |
| 6,044,659 | A * | 4/2000 | Ji | F25D 17/045 62/408 |
| 6,073,458 | A * | 6/2000 | Kim | F24F 13/12 62/186 |
| 6,584,790 | B1 * | 7/2003 | Lopes | F25D 17/045 165/294 |
| 9,562,620 | B2 * | 2/2017 | Da Pont | F25D 17/045 |
| 2010/0192617 | A1 | 8/2010 | Chae et al. | |
| 2013/0152621 | A1 * | 6/2013 | Lee | F25D 11/025 62/441 |
| 2014/0216071 | A1 | 8/2014 | Broadbent | |
| 2016/0138849 | A1 * | 5/2016 | Lee | F25D 17/06 62/186 |
| 2017/0227276 | A1 * | 8/2017 | Pearson | F25D 17/045 |
| 2018/0180346 | A1 * | 6/2018 | Shin | F25D 17/065 |

FOREIGN PATENT DOCUMENTS

| | | | |
|---|---|---|---|
| CN | 101368785 | A | 2/2009 |
| CN | 201251338 | Y | 6/2009 |
| CN | 101566420 | A | 10/2009 |
| CN | 101995135 | A | 3/2011 |
| CN | 102192630 | A | 9/2011 |
| CN | 203177563 | U | 9/2013 |
| CN | 103471317 | A | 12/2013 |
| CN | 204555502 | U | 8/2015 |
| JP | 63123971 | A | 5/1988 |
| JP | 1-203876 | A | 8/1989 |
| KR | 1990-0005682 | B1 | 8/1990 |
| KR | 1991-0005176 | Y1 | 7/1991 |
| KR | 10-2009-0043825 | A | 5/2009 |
| KR | 10-2010-0107168 | A | 10/2010 |
| WO | 2014/087312 | A1 | 6/2014 |

* cited by examiner

FIG. 14

| | REFRIGERATING CHAMBER Notch 1 | REFRIGERATING CHAMBER Notch 2 | REFRIGERATING CHAMBER Notch 3 | REFRIGERATING CHAMBER Notch 4 | REFRIGERATING CHAMBER Notch 5 | REFRIGERATING CHAMBER Notch 6 | REFRIGERATING CHAMBER Notch 7 |
|---|---|---|---|---|---|---|---|
| RT10 (WINTER) | Close | Close | Close | 1/4 Open | 1/2 Open | 3/4 Open | Full |
| RT25 (NORMAL) | 1/4 Open | 1/4 Open | 1/2 Open | 1/2 Open | 1/2 Open | 3/4 Open | Full |
| RT43 (SUMMER) | 1/4 Open | 1/4 Open | 1/2 Open | 1/2 Open | 3/4 Open | Full | Full |

REFRIGERATOR AND COLD AIR FLOW RATE MONITORING SYSTEM THEREOF

CROSS-REFERENCE TO RELATED APPLICATION

The application claims priority under 35 U.S.C. § 119 and 35 U.S.C. § 365 to Korean Patent Application No. 10-2015-0133373, filed on Sep. 21, 2015, whose entire disclosure is hereby incorporated by reference.

BACKGROUND OF THE INVENTION

1. Field

A refrigerator having a structure capable of adjusting a flow rate of cold air supplied into a refrigerator main body by a user's manual operation, and a monitoring system therefor.

2. Background

In general, a refrigerator keeps foods such as meat, fish, vegetables, fruits, beverages and the like in a fresh state. A conventional refrigerator includes a refrigerator main body having storage spaces such as a freezing chamber, a refrigerating chamber, vegetable chambers, and the like, a refrigerating cycle device provided in the refrigerator main body, and a door mounted to one side of the refrigerator main body to open and close the storage spaces.

The refrigerating cycle device of the refrigerator is activated when temperature of the freezing chamber or the refrigerating chamber is more than a preset temperature. In response to the activation of the refrigerating cycle device, cold air is generated in an evaporator and then circulates along the storage spaces. While the cold air circulates the storage spaces, the storage spaces are maintained at preset temperatures.

Refrigerators are classified into various types according to a method of circulating cold air, locations of a freezing chamber and a refrigerating chamber, and a configuration of an evaporator.

As one example, refrigerators may include a refrigerator that a freezing chamber is located above a refrigerating chamber, a refrigerator having a freezing chamber and a refrigerating chamber located side by side, a refrigerator having a freezing chamber located below a refrigerating chamber, and the like.

A chiller chamber may be formed at the lowermost portion of the refrigerating chamber. The chiller chamber may include a chiller chamber drawer, and a chiller chamber cover forming an upper surface of the chiller chamber drawer. The chiller chamber may be used to store meat and the like. The chiller chamber is preferably maintained at a low temperature close to 0° C. To this end, a duct with a cold air passage is installed in a rear side of the chiller chamber so as to supply cold air into the chiller chamber. The amount of cold air should be adjusted according to an amount of meat kept in the chiller chamber or an external temperature.

A conventional refrigerator includes a damper or an insulating material installed in the duct, along which the cold air flows, to adjust the amount of cold air supplied into the refrigerating chamber. However, the damper or the insulating material are not manually controlled by a user, but automatically controlled by electric power. Moreover, the amount of cold air was controlled by electrically adjusting an opening and closing amount of the damper, which has made it impossible to adjust the amount of cold air supplied into the refrigerating chamber according to a user's need.

Additionally, cold air supplied to the refrigerating chamber along the duct was not uniformly supplied through a cold air discharge opening.

Furthermore, the conventional refrigerator may include a system in which an abnormal operation state of a refrigerator is detected using an operation state monitoring sensor through a wired/wireless communication network, the detected data is transmitted to a management server, and the detected abnormal state is notified to a facility manager through a text message of a cellular phone. Such system does not provide information related to an amount of cold air supplied into a refrigerating chamber or an opening and closing amount of a cold air discharge opening. Therefore, the user cannot know the amount of cold air supplied into the refrigerating chamber or the opening and closing amount of the cold air discharge opening, thereby making it difficult to adjust the opening and closing amount of the cold air discharge opening.

SUMMARY OF THE INVENTION

The present disclosure is directed to providing a structure for adjusting a flow rate of cold air supplied into a refrigerating chamber according to a user's need in a manner of installing a knob, which is manually manipulated by a user, in replacement of an electrically-controlled damper.

Additionally, the present disclosure is directed to providing a structure of adjusting a flow rate of cold air, capable of reducing power consumption and material costs and implementing a user-desired temperature.

Additionally, the present disclosure is directed to providing a structure of a refrigerator capable of providing a user with information related to an amount of cold air supplied into a refrigerating chamber or an opening and closing amount of a cold air discharge opening.

Additionally, the present disclosure is directed to providing a refrigerator system capable of monitoring an amount of cold air supplied into a refrigerating chamber or an opening and closing amount of a cold air discharge opening, according to external temperature and internal temperature of the refrigerating chamber.

To achieve these and other advantages and in accordance with the purpose of this specification, as embodied and broadly described herein, there is provided a refrigerator including a refrigerator main body having a refrigerating chamber therein, a cold air passage duct disposed within the refrigerator main body and provided with a cold air passage therein, a control case coupled to the cold air passage duct and provided with a cold air discharge opening, a knob installed on the control case and opening and closing at least part of the cold air discharge opening in a manner of reciprocally moving in one direction, and a sensing unit configured to sense relative position of the knob with respect to the control case to acquire information related to an opening and closing amount of the cold air discharge opening, wherein the sensing unit includes a conductive member mounted on the knob and made of a conductive material, and a circuit portion provided on the control case and electrically connected to a different point of the conductive member according to a moved degree of the knob to construct a different circuit.

In accordance with one embodiment of the present invention, the conductive member may extend along the one direction.

The conductive member may include a plurality of protruding portions disposed on one side of the knob with being spaced apart from one another with a preset interval in the one direction, and a contact portion disposed with being spaced apart from a protruding portion, adjacent to another side of the knob, of the plurality of protruding portions, with a preset interval. The circuit portion may include an accommodating terminal electrically connected to one of the plurality of protruding portions in a manner of accommodating the one protruding portion during a movement of the knob, and a plurality of connection terminals disposed with being spaced apart from one another with a preset interval in one direction to be connected with the contact portion when the one protruding portion is accommodated in the accommodating terminal.

The plurality of connection terminals may electrically have the same polarity, and the accommodating terminal has an opposite polarity to the polarity of the plurality of connection terminals.

The control case may include a pressing protrusion protruding below the cold air discharge opening toward the cold air passage duct, to press a lower end portion of the knob. The knob may include a flow rate adjusting portion to adjust an opening and closing amount of the cold air discharge opening in response to being pressed by the pressing protrusion. The flow rate adjusting portion may include a plurality of protrusions disposed with being spaced apart from one another by a preset interval on the lower end portion of the knob, and a slot cut off in the one direction to enable an elastic transformation of the lower end portion of the knob in a state where the protrusions are pressed by the pressing protrusion.

The plurality of protrusions may be covered with the plurality of protruding portions, and the accommodating terminal may be disposed on one end of the pressing protrusion.

In accordance with another embodiment of the present invention, the control case may include a pressing protrusion protruding below the cold air discharge opening toward the cold air passage duct, to press a lower end portion of the knob, a first protruding portion protruding from one side below the cold air discharge opening toward the cold air passage duct, and brought into contact with the lower end of the knob to limit a downward movement of the knob and guide a lateral movement of the knob, and a second protruding portion disposed on one side of the pressing protrusion with the first protruding portion interposed therebetween, and protruding toward the cold air passage duct so as to limit the lateral movement of the knob.

The knob may include a first movement limit end portion provided on the lower end portion of the knob and brought into contact with the first protruding portion to limit the downward movement of the knob and guide the lateral movement of the knob, and a second movement limit end portion formed by cutting off a lower end portion of one side of the knob to be connected to the first movement limit end portion, and stopped by the second protruding portion to limit a movement of the knob in one side direction.

The control case may further include a third protruding portion protruding from another side below the cold air discharge opening toward the cold air passage duct, and brought into contact with at least part of the knob to limit the downward movement of the knob and guide the lateral movement of the knob, and a fourth protruding portion disposed on another side of the pressing protrusion with the third protruding portion interposed therebetween and protruding toward the cold air passage duct, to limit the lateral movement of the knob.

The knob may further include a third movement limit end portion formed by cutting off a lower end portion of another side of the knob, and stopped by the third protruding portion to limit the downward movement of the knob and guide the lateral movement of the knob, and a fourth movement limit end portion provided on the another side of the knob connected to the third movement limit end portion and stopped by the fourth protruding portion to limit a movement of the knob in another one side direction.

In accordance with one embodiment of the present invention, the control case may further include a knob coupling portion formed between both sides of the cold air discharge opening with being spaced apart from an upper portion of the cold air discharge opening by a predetermined distance, such that the knob is slidably coupled to the control case. The knob may further include a stopping portion formed by bending an upper end portion of the knob toward the knob coupling portion, such that the knob is slidably coupled to the knob coupling portion.

The knob may further include a cut portion formed by cutting off an at least part of an upper portion of the knob to communicate with the cold air discharge opening such that the cold air is discharged by opening at least part of one side of the cold air discharge opening. The cold air discharge opening may be disposed on each of both sides of the knob coupling portion, and both of the cold air discharge openings are configured to discharge the cold air therethrough in a manner that one of the cold air discharge openings is open while another cold air discharge opening is open in response to at least part of the another cold air discharge opening communicating with the cut portion.

Both of the cold air discharge openings formed adjacent to the knob coupling portion may always have the same area in a state of being opening and closing by the knob.

To achieve these and other advantages and in accordance with the purpose of this specification, as embodied and broadly described herein, there is provided a cold air flow rate monitoring system for a refrigerator, the system including a refrigerator having the aforementioned configuration, and a mobile terminal configured to perform wireless communication with the refrigerator, wherein the mobile terminal includes a display unit, a communication unit configured to receive relative position information on the knob with respect to the control case, and a controller configured to control the display unit to output the relative position information on the knob.

In accordance with one embodiment of the present invention, the mobile terminal may further include a storage unit configured to store reference position information on the knob with respect to the control case based on external temperature and internal temperature of a refrigerating chamber. The controller may control the display unit to output the reference position information and the relative position information related to the knob.

In accordance with another embodiment of the present invention, the mobile terminal may further include a calculating unit configured to calculate adjusted position information related to the knob based on the reference position information and the relative position information related to the knob, and the controller may control the display unit to output the adjusted position information related to the knob.

In accordance with another embodiment of the present invention, the refrigerator may further include a storage unit configured to store reference position information on the knob with respect to the control case based on external temperature and internal temperature of a refrigerating chamber, and a calculating unit configured to calculate adjusted position information related to the knob based on the reference position information and the relative position information related to the knob. The controller of the mobile terminal may control the display unit to output the adjusted position information related to the knob.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings:

FIG. 14 is a table showing reference position information related to the knob with respect to the control case based on external temperature and internal temperature of the refrigerating chamber.

DETAILED DESCRIPTION OF THE INVENTION

Hereinafter, exemplary embodiments of the present disclosure invention will be described in detail with reference to the accompanying drawings. It is understood that the description herein is not intended to limit the claims to the specific embodiments described. On the contrary, it is intended to cover alternatives, modifications, and equivalents as may be included within the spirit and scope of the present disclosure.

For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, moreover, the detailed description is omitted when a specific description for publicly known technologies to which the invention pertains is judged to obscure the gist of the present disclosure. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It is understood that although the terms first, second, etc. may be used herein to describe various elements, these elements should not be limited by these terms. These terms are generally only used to distinguish one element from another.

It is understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of features, numbers, steps, functions, several components, or combinations thereof, disclosed in the specification, and it is also understood that greater or fewer features, numbers, steps, functions, several components, or combinations thereof may likewise be utilized.

Figure 1A:
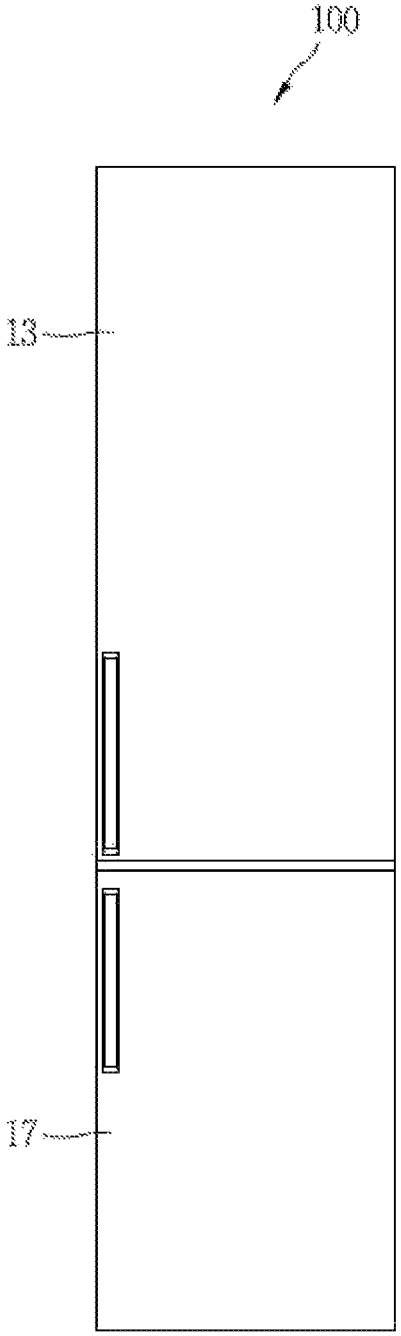
FIG. 1A is a conceptual view illustrating an interior of a refrigerator in accordance with the present disclosure.
Figure 1B:
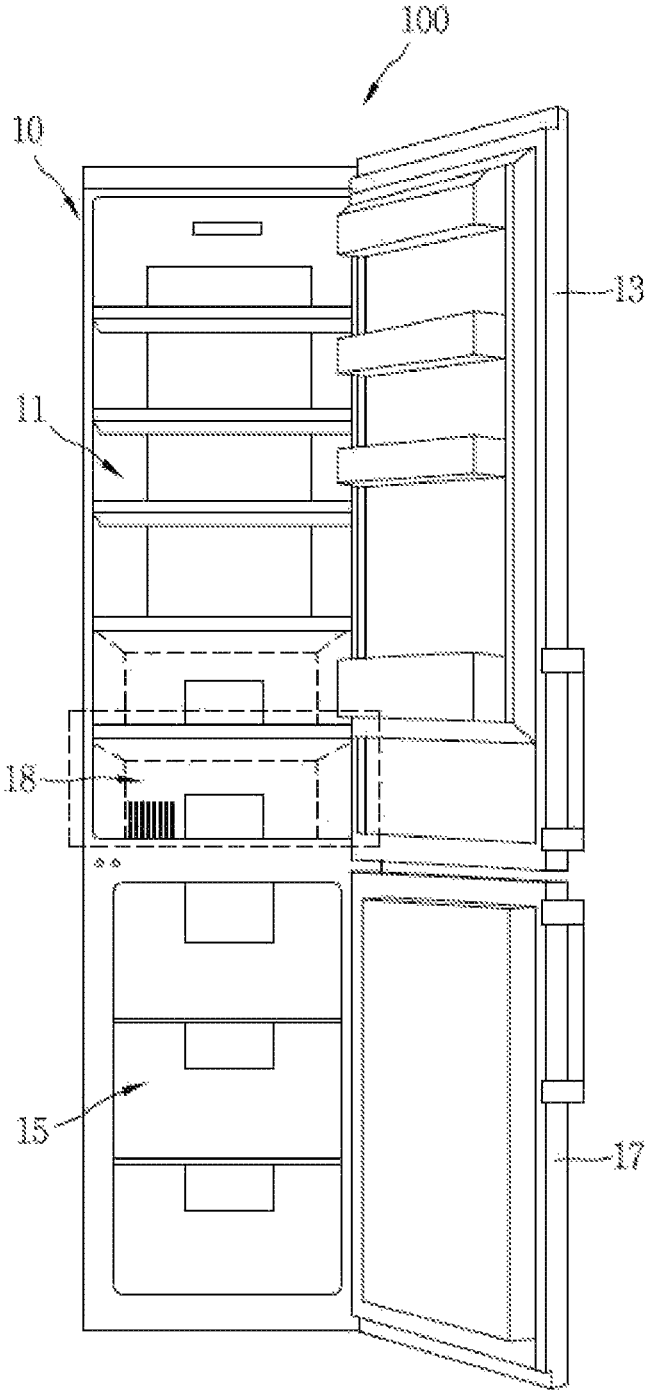
FIG. 1B is a view of the refrigerator illustrated in FIG. 1A with the refrigerating chamber door and the freezing chamber door open to illustrate an interior of the refrigerator in accordance with the present disclosure.
Figure 2:
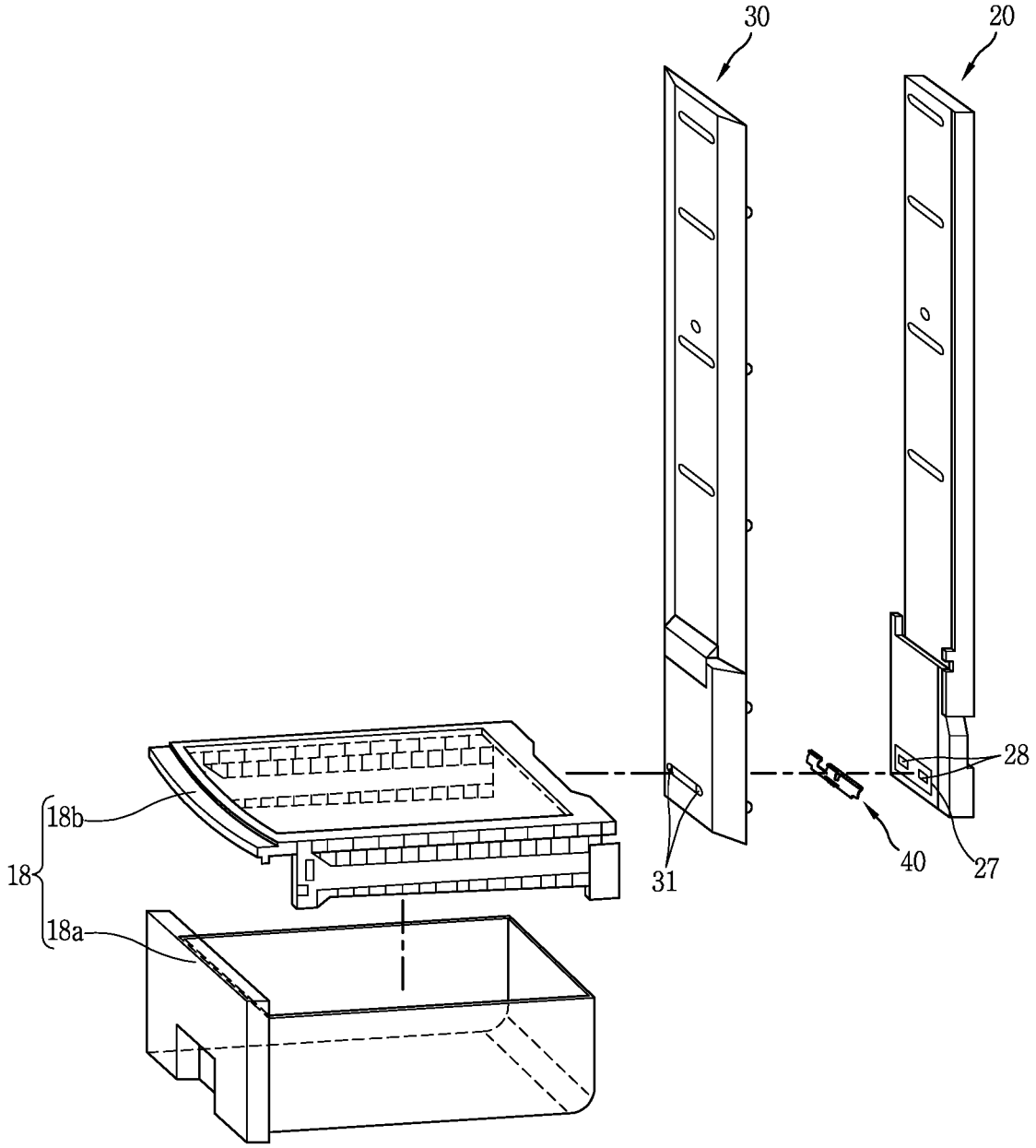
FIG. 2 is a disassembled perspective view illustrating the structure related to the refrigerator illustrated in FIGS. 1A and 1B.

FIG. 1A is a conceptual view illustrating an exterior of a refrigerator 100 in accordance with an embodiment of the present disclosure. FIG. 1B is a view of the refrigerator illustrated in FIG. 1A with the refrigerating chamber door and the freezing chamber door open to illustrate an interior of the refrigerator. FIG. 2 is a disassembled perspective view illustrating a structure related to the refrigerator 100 illustrated in FIGS. 1A and 1B.

Hereinafter, an overall configuration of a refrigerator 100 according to an embodiment of the present disclosure is described with reference to FIGS. 1A, 1B, and 2.

As shown, a refrigerator 100 may include a refrigerator main body 10, a cold air passage duct 20, a control case 30, a knob 40, and a sensing unit 50. The refrigerator main body 10 may include therein a refrigerating chamber 11 and a freezing chamber 15. For example, the refrigerator disclosed herein may be a bottom freezer type refrigerator.

FIGS. 1A and 1B illustrate the bottom freezer type refrigerator 100. In the bottom freezer type refrigerator 100, a lower space is configured as the freezing chamber 16 and an upper space relative to the lower space is configured as the refrigerating chamber 11. A freezing chamber door 17 for opening and closing the freezing chamber 15 and a refrigerating chamber door 13 for opening and closing the refrigerating chamber 11 may be coupled to the refrigerator main body 10.

The present disclosure is preferably applied to the bottom freezer type refrigerator, but is not limited thereto. It is understood that the present disclosure may be applied to various types of refrigerators by adjusting an arrangement of the knob 40, a cold air discharge opening 31, and the like, which are explained in more detail below.

Specifically, in the structure disclosed herein, a chiller chamber drawer 18*a* may be attached to the lowermost end of the refrigerating chamber 11, and a chiller chamber cover 18*b* that forms an upper surface of the chiller chamber 18 may be attached to an upper portion of the chiller chamber drawer 18*a*. Together, the chiller chamber drawer 18*a* and the chiller chamber cover 18*b* may be referred to as the chiller chamber 18. The chiller chamber 18 may store meat, and the like, and is preferably maintained at a relatively low temperature close to 0° C.

An introduction of cold air into the chiller chamber drawer 18*a* disposed at the lowermost end of the refrigerating chamber 11 should be allowed. A cold air passage duct 20 and the control case 30 may be disposed at an upper portion of a rear surface of the chiller chamber drawer 18*a* and configured to communicate with the cold air discharge opening 31.

The cold air passage duct 20 may be installed within the refrigerator main body 10. The cold air passage duct 20 may include a cold air passage 23 (see e.g., FIG. 7). As illustrated in FIGS. 1A, 1B, and 2, the cold air passage duct 20*a* may be provided at a rear wall side of the refrigerating chamber 11 to allow cold air to be discharged into the refrigerating chamber 11.

Cold air generated in an evaporator may flow along the cold air passage 23 of the cold air passage duct 20. In the cold air passage duct 20 of the present disclosure, similar to a conventional refrigerator, a refrigerating cycle is provided to supply cold air in response to a status change of a refrigerant. Components of the refrigerating cycle, such as an evaporator, a compressor, a condenser and an expansion valve, are components applied to a conventional refrigerator refrigerating cycle, so for convenience purposes a detailed description thereof is omitted.

The control case 30 may be installed at one surface of the cold air passage duct 20. The control case 30 may be provided with the cold air discharge opening 31 through which cold air within the cold air passage duct 20 is discharged. The control case 30 may be understood as a plate structure coupled to one surface of the cold air passage duct 20. As illustrated in FIG. 2, the cold air passage duct 20 may be attached to a front surface of the cold air passage duct 20.

The cold air passage duct 20 may be provided with a knob accommodating portion 27 for accommodating the knob 40 in a manner of allowing a reciprocal movement of the knob 40, which is explained in more detail below. The knob accommodating portion 27 may be formed greater than the knob 40, considering the coupling with the reciprocally-movable knob 40. The knob accommodating portion 27 is provided with a cold air communicating outlet 28 which communicates with the cold air discharge opening 31 of the control case 30 to be explained later and the cold air passage 23 within the cold air passage duct 20.

Figure 5:
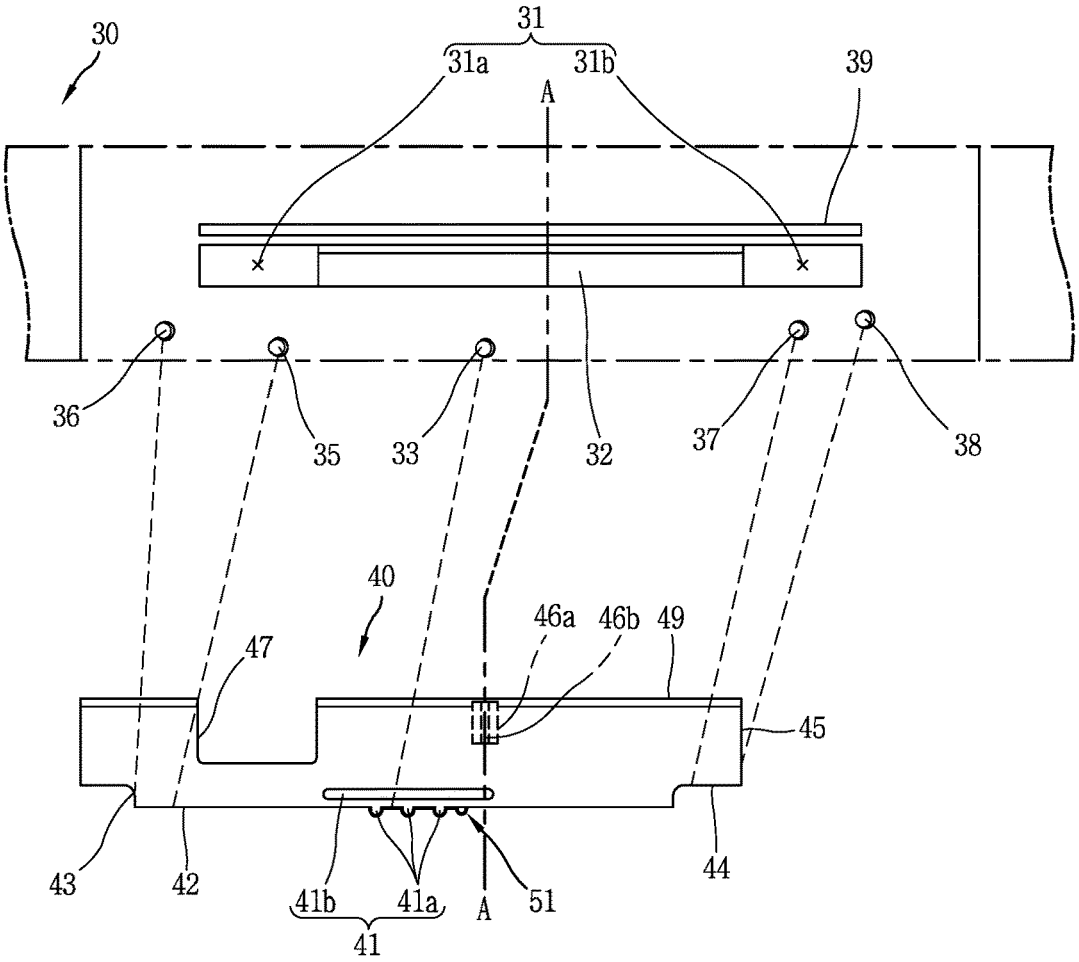
FIG. 5 is a conceptual view illustrating a correspondence between the control case and the knob according to the present disclosure.

A detailed structure of the control case 30 related to the present invention is described in more detail together with the shutter 40, with reference to FIG. 5.

Figure 3:
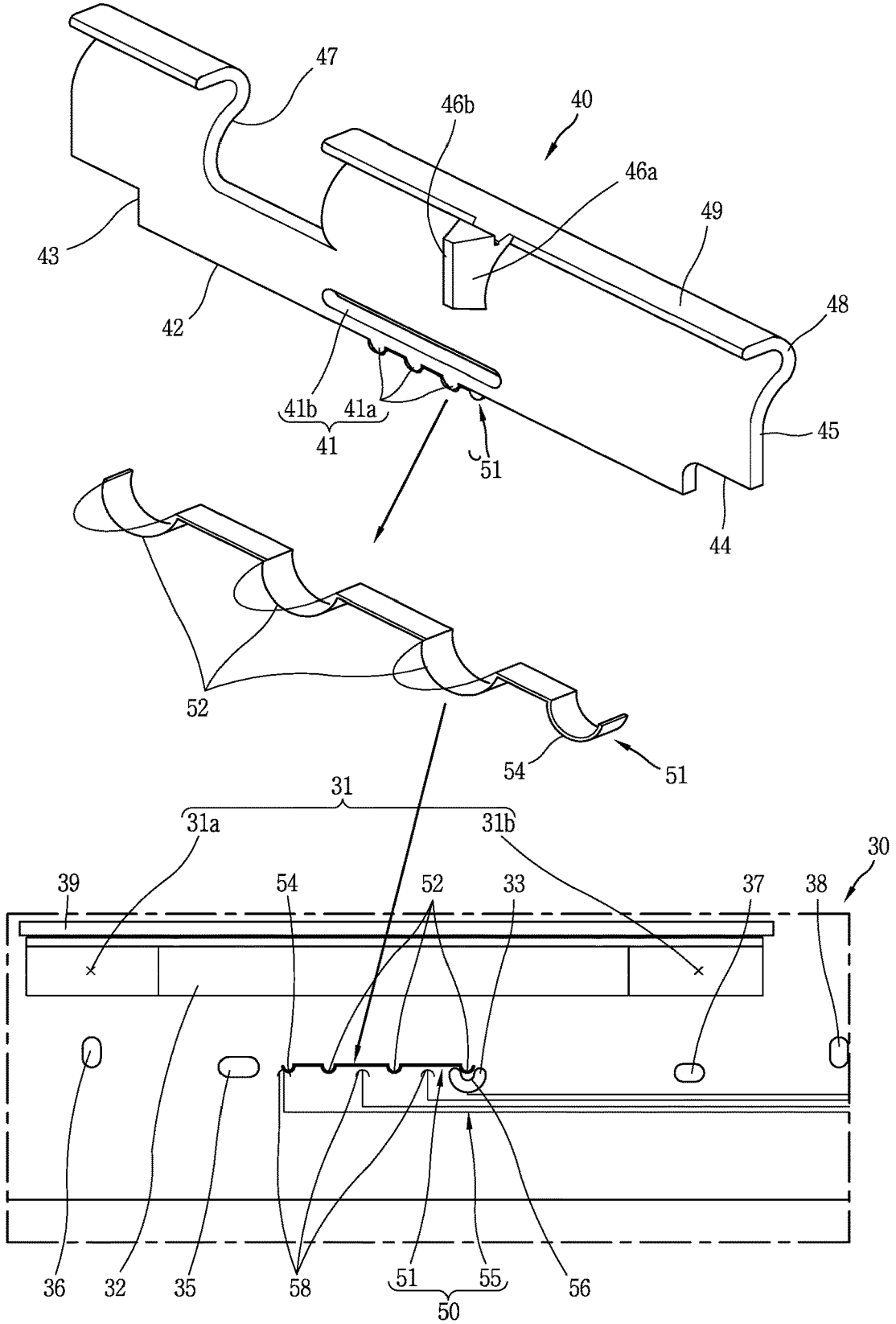
FIG. 3 is conceptual view illustrating a knob, a control case and a sensing unit coupled to them in accordance with the present disclosure.
Figure 4:
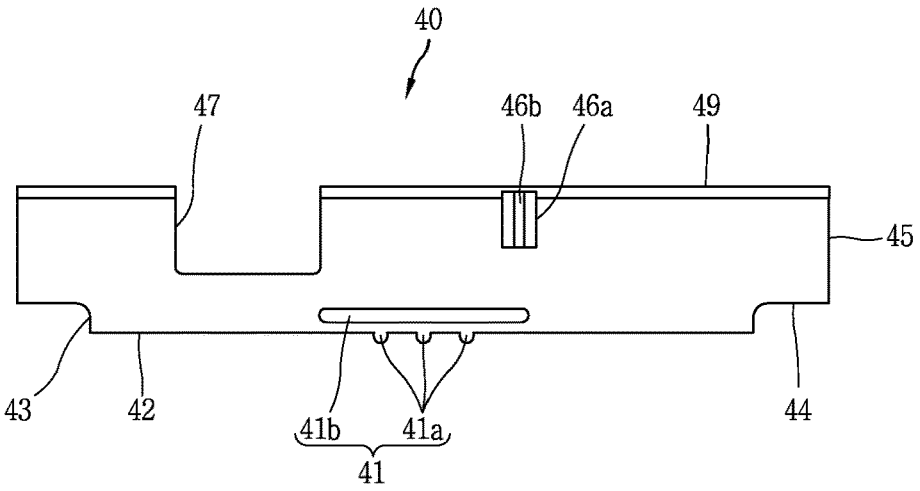
FIG. 4 is a front view of the knob illustrated in FIG. 3.

FIG. 3 is conceptual view illustrating the knob 40, the control case 30, and the sensing unit 50 coupled to them in accordance with the present disclosure. FIG. 4 is a front view of the knob 40 illustrated in FIG. 3.

Hereinafter, the structures of the knob 40 and the sensing unit 50 are described with reference to FIG. 4.

The knob 40 opens and closes at least part of the cold air discharge opening 31, as illustrated in FIG. 5. The knob 40 may be disposed between the cold air passage duct 20 and the control case 30, and installed on the control case 30 to be reciprocally movable in one direction.

The knob 40 may include a flow rate adjusting portion 41. The flow rate adjusting portion 31 adjusts a flow rate of cold air by adjusting a communicating area between a cut portion 47 (explained in more detail below) and the cold air discharge opening 31. The flow rate adjusting portion 41 may include a plurality of protrusions 41*a* and a slot 41*b*.

As illustrated, the plurality of protrusions 41*a* may be disposed at a lower end portion of the knob 40 with being spaced apart from one another by a preset interval. FIG. 3 illustrates one example showing three protrusions 41*a* at the lower end portion of the knob 40. In this example, during a movement of the knob 40 in one direction, the plurality of protrusions 41*a* sequentially move over a pressing protrusion 33 (explained in more detail below). Accordingly, an opening and closing amount or level of the cold air discharge opening 31 is adjusted.

As explained in more detail below, the plurality of protrusions 41*a* may be coupled with a conductive member 51. The conductive member 51 configures the sensing unit 50 together with a circuit portion 55. The sensing unit 50 senses a relative position of the knob 40 with respect to the control case 30.

The slot 41*b*, which is cut off in one direction, is formed at a position adjacent to the lower end portion of the knob 40 with the plurality of protrusions 41*a*. The slot 41*b* enables an elastic transformation of the lower end portion of the knob 40 in a state in which the plurality of protrusions 41*a* are pressed by the pressing protrusion 33, thereby reducing a concentration of stress applied to the knob 40 and the pressing protrusion 33 and minimizing a risk of damage. The slot 41*b* may be understood as an elastic space in which the lower end portion of the knob 40 with the plurality of protrusions 41*a* is elastically transformed.

FIGS. 3 and 4 illustrate one example in which the plurality of protrusions 41*a* protrude from the lower end portion of the knob 40 with predetermined intervals from one another in a lengthwise direction. However, a plurality of protrusions 41*c* may be formed within a slot 41*d*, which is described later with reference the embodiment illustrated in FIG. 11.

The sensing unit 50 illustrated in FIG. 3 senses a relative position of the knob 40 with respect to the control case 30 and acquires information related to an opening and closing amount of the cold air discharge opening 31.

In the following description, the relative position of the knob with respect to the control case 30 refers to a relative position of the knob 40 reflecting the information on the opening and closing amount of the cold air discharge opening 31.

As illustrated, the sensing unit 50 may include a conductive member 51 and a circuit portion 55.

The conductive member 51 is made of a conductive material. For example, the conductive member 51 may be made of a metal facilitating a flow of current, such as copper, silver, etc. The conductive member 51 may be mounted on the knob 40 and extend in one direction. The conductive member 51 may cooperatively move in response to a relative movement of the knob 40 with respect to the control case 30, which allows an electric connection of a part of the circuit portion 55 (is explained in more detail below).

The conductive member 51 may include a plurality of protruding portions 52 and a plurality of contact portions 54.

The plurality of protruding portions 52 may be disposed at one side of the knob 40 in one direction with being spaced apart from one another by a "preset interval." The "preset interval" may be referred to as a first interval. The plurality of protruding portions 52 cover the plurality of protrusions 41*a*, and are pressed by a pressing protrusion 33 to be stably electrically connected to an accommodation terminal 56. It is understood that the plurality of protrusions 41*a* may also be disposed with the "preset interval" in the structure that the plurality of protrusions 41*a* are covered with the plurality of protruding portions 52.

There may be more than one protruding portion 52. In general, more specialized information related to the opening and closing amount of the cold air discharge opening 31 may be provided as the number of protruding portion 52 increases.

For example, the contact portion 54 may be disposed spaced apart from the protruding portion 52, which is adjacent to another side of the knob 40 of the plurality of protruding portions 52, by a "predetermined interval." The "predetermined interval" may be referred to as a second interval. The second interval refers to a different distance from the first interval. The contact portion 54 may have a structure without covering a plurality of protrusions. Because the contact portion 54 is disposed according to the second interval (not the first interval) from the another side protruding portion 52, a different circuit of the circuit portion 55 can be electrically connected in response to the relative movement of the knob 40.

FIG. 3 illustrates one example in which the plurality of protruding portions 52 cover the plurality of protrusions 41*a* of the knob 40 and the contact portion 54 is disposed with being spaced by the second interval apart from one side protrusion of the plurality of protrusions 41*a*.

As illustrated, the circuit portion 55 is provided on the control case 30, and electrically connected to a different point of the conductive member 51 according to a moved degree (or moved distance) of the knob 40, thereby constructing a different circuit. The circuit portion 55 may include an accommodating terminal 56 and a plurality of connection terminals 58.

The accommodating terminal 56 accommodates one of the plurality of protruding portions 52 and is electrically connected to the protruding portion 52 during the movement of the knob 40. Thus, for example, when the knob 40 moves relative to the control case 30, the protruding portions 52 are electrically connected to the accommodating terminal 56 in a sequential manner.

The accommodating terminal 56 may be spaced apart by the second interval, from one connection terminal 58, which is disposed at one side thereof, of the plurality of connection terminals 58. FIG. 3 illustrates one example in which the aforementioned contact portion 54 is disposed at a left side of the plurality of protruding portions 52 with the spaced distance, and the accommodating terminal 56 is disposed at a right side of the connection terminals 58 with a spaced distance. As such, the contact portion 54 and the accommodating terminal 56 are preferably disposed at opposite sides to each other.

The accommodating terminal 56 may be installed at one end of the pressing protrusion 33. Thus, in a state in which one of the plurality of protrusions is accommodated in the pressing protrusion 33, the electric connection between the protruding portion 52 and the accommodating terminal 56 may be maintained more stably.

As illustrated, the plurality of connection terminals 58 are disposed with being spaced apart from one another with a "preset interval" in one direction while the protruding portion 52 is accommodated in the accommodating terminal 56, so as to be connectable with the contact portion 54. The "preset interval" may be the spaced interval between the adjacent protruding portions of the plurality of protruding portions 52, and thus may be understood as the aforementioned first interval.

The plurality of connection terminals 58 may electrically have the same polarity, and the accommodating terminal 56 may have an opposite polarity to the polarity of the plurality of connection terminals 58. For example, each of the plurality of connection terminals 58 may have a negative (or minus (−)) polarity, and the accommodating terminal 56 may have a positive (or plus (+)) polarity. This may allow one of the plurality of connection terminals 58 and the accommodating terminal 56 to be electrically connected to each other by the conductive member 51.

Each of the plurality of connection terminals 58 and the accommodating terminal 56 of the circuit portion 55 may be connected with a wire. The wires may be connected to a printed circuit board (PCB). When one of the plurality of connection terminals 58 is electrically connected to the accommodating terminal 56, the PCB may sense it and store a different electric signal.

Also, referring to FIGS. 3 and 4, the knob 40 may include first to fourth movement limit end portions 42, 43, 44, and 45, a stopping portion 46*a*, a cut portion 47, and a bent portion 48. Hereinafter, moving directions (up, down, left, right) of the knob 40 are defined based on the front view of FIG. 4.

As illustrated, the first movement limit end portion 42 may be provided at a lower end of the knob 40, and brought into contact with a first protruding portion 35 so as to limit a downward movement of the knob 40 and guide a lateral movement of the knob 40. For example, the first movement limit end portion 42 may be formed at a position adjacent to the plurality of protrusions 41*a* which downwardly protrude from the lower end portion of the knob 40.

The second movement limit end portion 43 may be stopped by a second protruding portion 36 so as to limit a movement of the knob 40 in one side direction. The second movement limit end portion 43 may be formed by cutting off a lower end portion of one side of the knob 40 to be connected to the first movement limit end portion 42. FIGS. 3 and 4 illustrate one example in which the second movement limit end portion 43 is formed by cutting off an edge portion of a left lower end of the knob 40 and stopped by the second protruding portion 36 so as to limit a left movement of the knob 40.

The third movement limit end portion 44 may be formed by cutting off a lower end portion of another side of the knob 40. The third movement limit end portion 44 may be stopped by a third protruding portion 37 so as to limit a downward movement of the knob 40 and guide a lateral movement of the knob 40. FIGS. 3 and 4 illustrate one example in which the third movement limit end portion 44 is formed by cutting off a right lower end portion of the knob 40.

The fourth movement limit end portion 45 may be connected to the third movement limit end portion 44. The fourth movement limit end portion 45 may be stopped by a fourth protruding portion 38 to limit a movement of the knob 40 in another side direction. Referring to FIGS. 3 and 4, the fourth movement limit end portion 45 may be understood as an end portion formed at a right side of the knob 40.

The stopping portion 46*a* may cover the knob coupling portion 32 of the control case 30. The stopping portion 46*a* may be formed by bending an upper end portion of the knob 40 toward a knob coupling portion 32 so as to be slidably stopped in the knob coupling portion 32. The stopping portion 46*a* thus allows the knob 40 to be located between the control case 30 and the cold air passage duct 20.

The stopping portion 46*a* may include a knob handle 46*b* protruding therefrom toward a front side. A user may manipulates the knob handle 46*b* in a left and right direction such that the knob 40 can be slid. By doing so, the cut portion 47 of the knob 40 may communicate with the cold air discharge opening 31, thereby adjusting the opening and closing amount of the cold air discharge opening 31.

The knob handle 46*b* may also be disposed at a front side of the control case 30 to be manipulated by the user.

The cut portion 47 may be formed, for example, by cutting off at least part of an upper portion of the knob 40 to communicate with the cold air discharge opening 31, such that at least part of one side of the cold air discharge opening 31 is open thereby to discharge the cold air. The cut portion 47 does not communicate with the cold air discharge opening 31 when the cold air discharge opening 31 is closed, and at least part of the cut portion 47 communicates with the cold air discharge opening 31 when the cold air discharge opening 31 is opened.

A fifth movement limit end portion 49 may be formed at an upper end portion of the knob 40. The fifth movement limit end portion 49 may be brought into contact with a limit rib 39 formed above the cold air discharge opening 31 to limit an upward movement of the knob 40 and guide a lateral movement of the knob 40. As illustrated in FIG. 3, the fifth movement limit end portion 49 may be formed at an end portion of a bent portion 48 of the knob 40. Thus, the fifth movement limit end portion 49 may be an upper end surface of the knob 40 including a curved surface.

Figure 6:
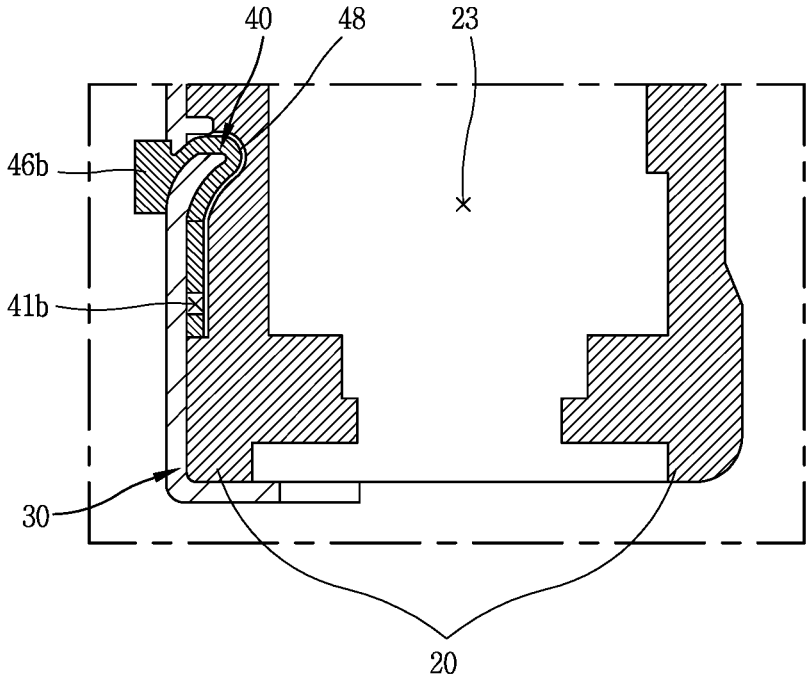
FIG. 6 is a side sectional view taken along the line A-A' of FIG. 5.

Referring to FIGS. 3 and 6, the knob 40 may include the bent portion 48 having an upper side formed in a bent shape. The knob 40 may be coupled to the knob coupling portion 32 and cover at least part of the knob coupling portion 32, which may allow the knob 40 to be more stably coupled to the control case 30. Moreover, with this structure, even when the knob 40 is repetitively slid, stress which is concentrated on the knob 40 may be dispersed, thereby improving durability.

FIG. 5 is a conceptual view illustrating a correspondence between the control case 30 and the knob 40 according to an embodiment of the present disclosure. FIG. 6 is a side sectional view taken along the line A-A' of FIG. 5.

Hereinafter, a structure of the control case 30 and a coupling relationship between the control case 30 and the knob 40 are described with reference to FIGS. 5 and 6.

As illustrated, the control case 30 may be provided with a pressing protrusion 33 which protrudes from a lower portion of the cold air discharge opening 31 toward the cold air passage duct 20. The pressing protrusion 33 may press against the plurality of protrusions 41*a* and then settle between the plurality of protrusions 41*a*, thereby adjusting the opening and closing amount of the cold air discharge opening 31. FIG. 5 illustrates one example of the pressing protrusion 33 that protrudes from the lower portion of the cold air discharge opening 31 formed on the control case 30 and spaced apart from the lower portion by a predetermined distance.

For example, referring to FIG. 3, the pressing protrusion 33 may be formed in a structure capable of accommodating the plurality of protrusions 41*a* or the plurality of protruding portions 52 coupled to the plurality of protrusions 41*a*. When the pressing protrusion 33 has the structure of accommodating the plurality of protruding portions 52, the accommodating terminal 56 is installed at one end of the pressing protrusion 33 with which the plurality of protruding portions 52 are brought into contact.

The control case 30 may include first and second protruding portions 35 and 36, such as illustrated in FIGS. 3 and 5.

As illustrated, the first protruding portion 35 may protrude from a left lower side of the cold air discharge opening 31 toward the cold air passage duct 20. As illustrated in FIG. 5, the first protruding portion 35 may be brought into contact with the first movement limit end portion 42 located at the lower end of the knob 40 so as to limit the downward movement of the knob 40 and guide the lateral movement of the knob 40.

The second protruding portion 36 may be spaced apart from the first protruding portion 35 and protrude toward the cold air passage duct 20 so as to limit the lateral movement of the knob 40. As illustrated in FIG. 5, the second protruding portion 36 may be disposed at a left side of the pressing protrusion 33 and stopped by the second movement limit end portion 43 so as to limit the left movement of the knob 40.

The control case 30 may include third and fourth protruding portions 37 and 38, as illustrated in FIGS. 3 and 5.

The third protruding portion 37 may protrude from a right lower side of the cold air discharge opening 31 toward the cold air passage duct 20. As illustrated in FIG. 5, the third protruding portion 37 may be brought into contact with the third movement limit end portion 44 so as to limit the downward movement of the knob 40 and guide the lateral movement of the knob 40.

The fourth protruding portion 38 may be disposed at a right side of the third protruding portion 37 with a spaced distance to limit the lateral movement of the knob 40, and protrude toward the cold air passage duct 20. As illustrated in FIG. 5, the fourth protruding portion 38 may be stopped by the fourth movement limit end portion 45 so as to limit the rightward movement of the knob 40.

Referring to FIG. 5, the pressing protrusion 33 may be disposed below the cold air discharge opening 31 and spaced apart from the cold air discharge opening 31, the first and second protruding portions 35 and 36 may be sequentially disposed at the left side of the pressing protrusion 33, and the third and fourth protruding portions 37 and 38 may be sequentially disposed at the right side of the pressing protrusion 33.

The control case 30 may include the knob coupling portion 32. The knob coupling portion 32 may be formed between both sides of the cold air discharge opening 31 and spaced apart from an upper portion of the cold air discharge opening 31 by a predetermined distance. The cold air discharge opening 31 may be formed at each of both sides of the knob coupling portion 32. Thus, referring to FIG. 5, the cold air discharge opening 31 formed at the left side of the control case 30 may be referred to as a first cold air discharge opening 31*a*, and the cold air discharge opening 31 formed at the right side of the control case 30 may be referred to as a second cold air discharge opening 31*b*.

Explaining the first and second cold air discharge openings 31*a* and 31*b*, in a state that the knob 40 is coupled to the knob coupling portion 32 to be reciprocally movable, the first cold air discharge opening 31*a* may communicate with the cut portion 47 of the knob 40 so as to be open. In this instance, the fourth movement limit end portion 45 may open the second cold air discharge opening 31*b*. As such, the first and second cold air discharge openings 31*a* and 31*b* may open and close at the same time in response to the reciprocal movement of the knob 40.

The first and second cold air discharge openings 31*a* and 31*b* may be open in a manner of always having the same area. In other words, a width of the first cold air discharge opening 31*a* in a left and right direction may be the same as a width of the cut portion 47 in the left and right direction, and also a distance from one end of a right side of the cut portion 47 to the fourth movement limit end portion 45 may be the same as a distance in the left and right direction of the knob coupling portion 32 disposed between the first and second cold air discharge openings 31*a* and 31*b*.

The cold air discharge opening 31 may be formed, for example, by dividing both sides thereof into the first and second cold air discharge openings 31*a* and 31*b* such that the first and second cold air discharge openings 31*a* and 31*b* always have the same area in the open state of the knob 40. This structure may prevent more cold air from being supplied through one side of the cold air discharge opening 31, and allow the cold air to be uniformly supplied into the refrigerating chamber 11.

A limit rib 39 that limits the upward movement of the knob 40 may be provided, whereby the limit rib 39 protrudes above the cold air discharge opening 31. The limit rib 39 may be brought into contact with the fifth movement limit end portion 49 located at the upper side of the knob 40, to limit the upward movement of the knob 40 and guide the lateral movement of the knob 40.

Figure 7:
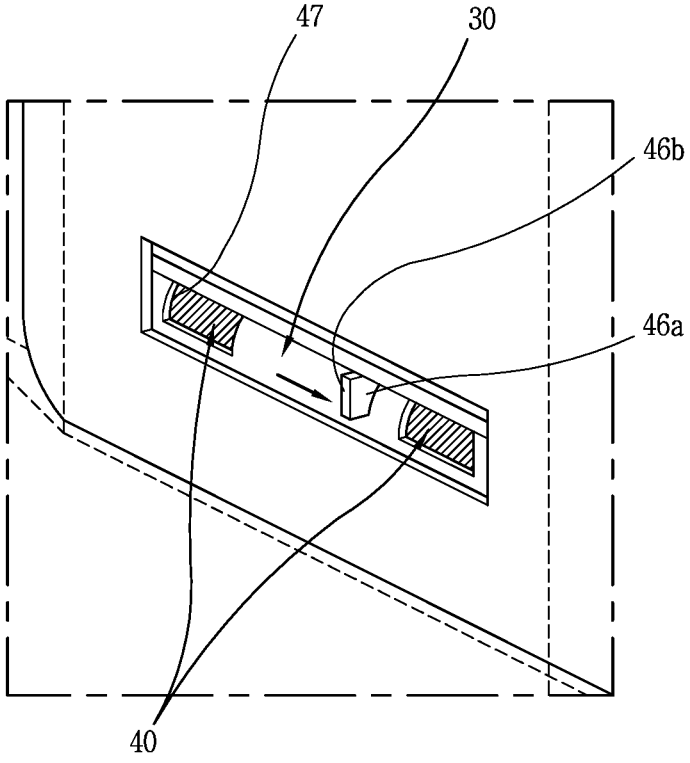
FIG. 7 is a conceptual view illustrating a closed state of a cold air discharge opening by the knob according to the present disclosure.
Figure 8:
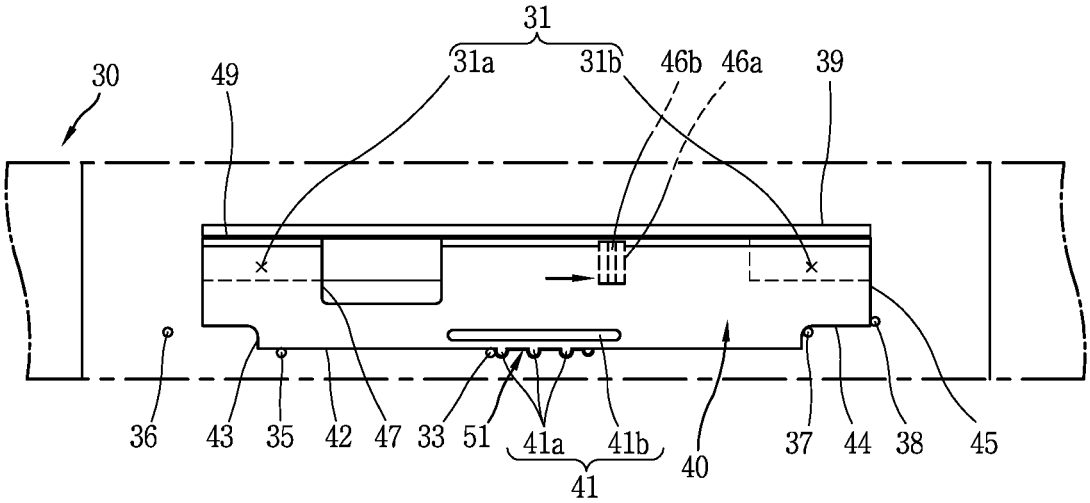
FIG. 8 is a conceptual view illustrating a coupling relationship between the knob and the control case in a state illustrated in FIG. 7.
Figure 9:
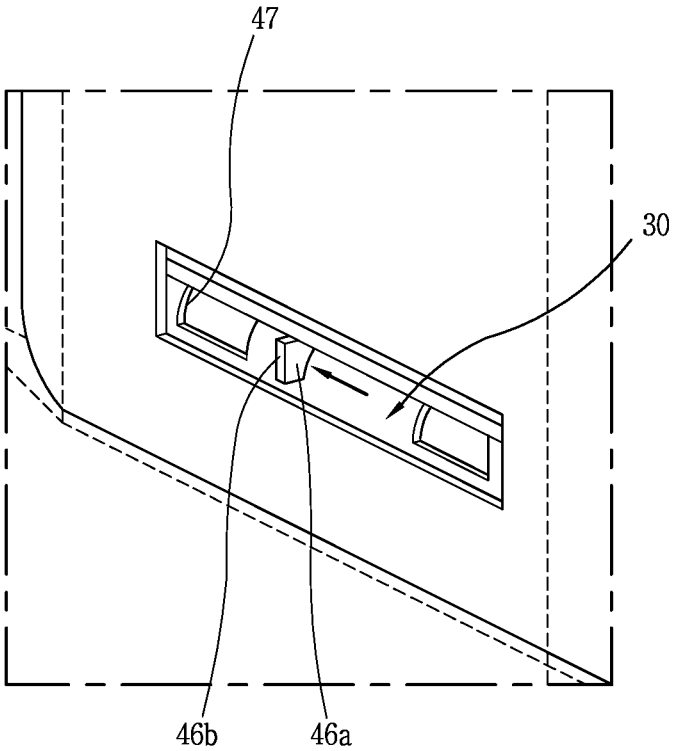
FIG. 9 is a conceptual view illustrating an open state of the cold air discharge opening by the knob according to the present disclosure.
Figure 10:
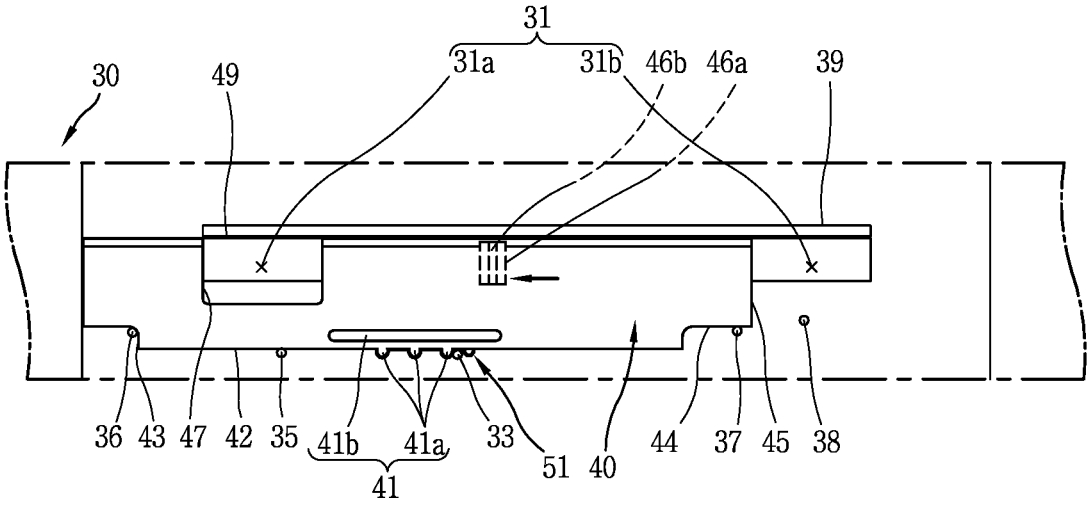
FIG. 10 is a conceptual view illustrating a coupling relationship between the knob and the control case in a state illustrated in FIG. 9.

FIG. 7 is a conceptual view illustrating a closed state of the cold air discharge opening 31 by the knob 40 in accordance with an embodiment of the present disclosure. FIG. 8 is a conceptual view illustrating a coupling relationship between the knob 40 and the control case 30 in the state of FIG. 7. FIG. 9 is a conceptual view illustrating an open state of the cold air discharge opening 31 by the knob 40. FIG. 10 is a conceptual view illustrating a coupling relationship between the knob 40 and the control case 30 in the state of FIG. 9.

Hereinafter, operations of the knob 40 installed on the control case 30 related to the refrigerator 100 according to an embodiment of the present invention is described with reference to FIGS. 5 and 7 to 10.

FIGS. 7 and 8 illustrate a state in which the knob 40 is moved in an arrow direction and closes the first and second cold air discharge openings 31*a* and 31*b*, according to an embodiment of the present disclosure.

In this state, the fourth movement limit end portion 45 is brought into contact with the fourth protruding portion 38, and the first and third movement limit end portions 42 and 44 are brought into contact with the first and third protruding portions 35 and 37, respectively, so as to limit the downward movement of the knob 40 and guide the lateral movement of the knob 40. Also, as shown, the second protruding portion 36 is spaced apart from the second movement limit end portion 43.

As illustrated, the first cold air discharge opening 31*a* may be closed by a portion of the knob 40 located near the left side of the cut portion 47 of the knob 40, and the second cold air discharge opening 31*b* may be closed by a portion of the knob 40 located near the fourth movement limit end portion 45.

FIGS. 9 and 10 illustrate a state in which the knob 40 is moved in an arrow direction and opens the first and second cold air discharge openings 31*a* and 31*b*, according to an embodiment of the present disclosure.

In this state, the second movement limit end portion 43 is brought into contact with the left second protruding portion 36, and the first and third movement limit end portions 42 and 44 are brought into contact with the first and third protruding portions 35 and 37, to limit the downward movement of the knob 40 and guide the lateral movement of the knob 40. Also, as shown, the fourth protruding portion 38 is spaced apart from the fourth movement limit end portion 45.

Thus, as the knob 40 is moved in a manner that the cut portion 47 communicates with the first cold air discharge opening 31*a* and the fourth movement limit end portion 45 is disposed at the left side of the second cold air discharge opening 31*b*, both of the first cold air discharge opening 31*a* and the second cold air discharge opening 31*b* are open.

FIGS. 7 to 10 illustrate examples in which the cold air discharge opening 31 is fully closed and fully opened. However, it is understood that the knob 40 may be manipulated to open only a part of the cold air discharge opening 31, and even in this instance, the first cold air discharge opening 31*a* and the second cold air discharge opening 31*b* have the same area.

One of the plurality of protrusions 41*a* may be pressed by the pressing protrusion 33 and another one of the plurality of protrusions 41*a* may move over the pressing protrusion 33. Thus, when the one protrusion of the plurality of protrusions 41*a* is pressed by the pressing protrusion 33, the lower end portion of the knob 40 is elastically transformed upwardly.

In a state in which the pressing protrusion 33 is disposed between the neighboring protrusions of the plurality of protrusions 41*a*, the cold air discharge opening 31 is adjusted to be open by a predetermined area.

Figure 11A:
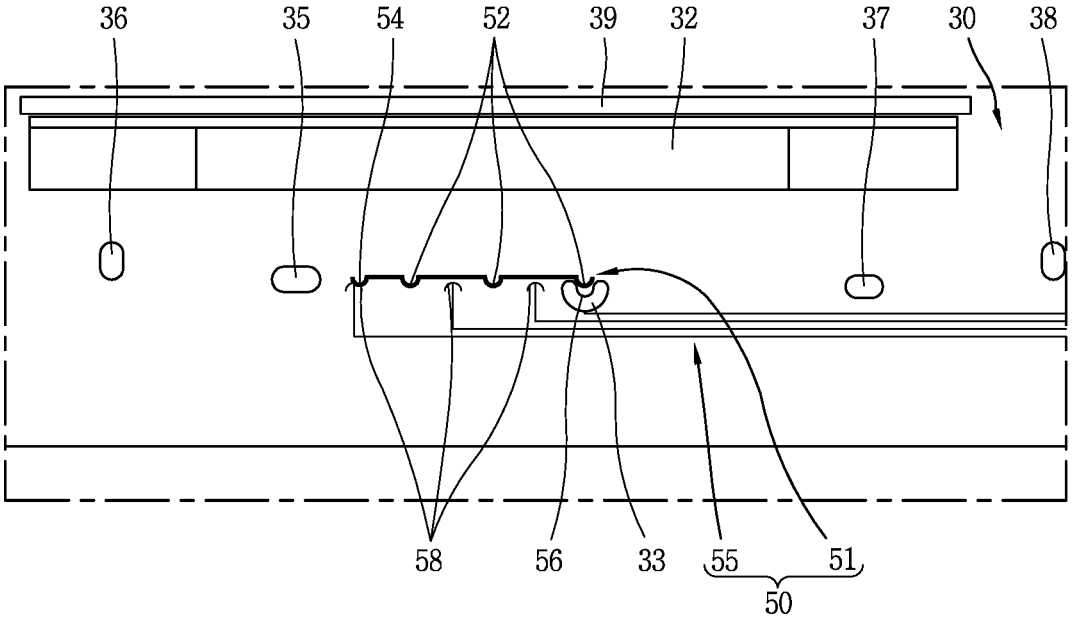
FIG. 11A is a conceptual view illustrating an operation of a sensing unit in a closed state of the cold air discharge opening according to the present disclosure.
Figure 11B:
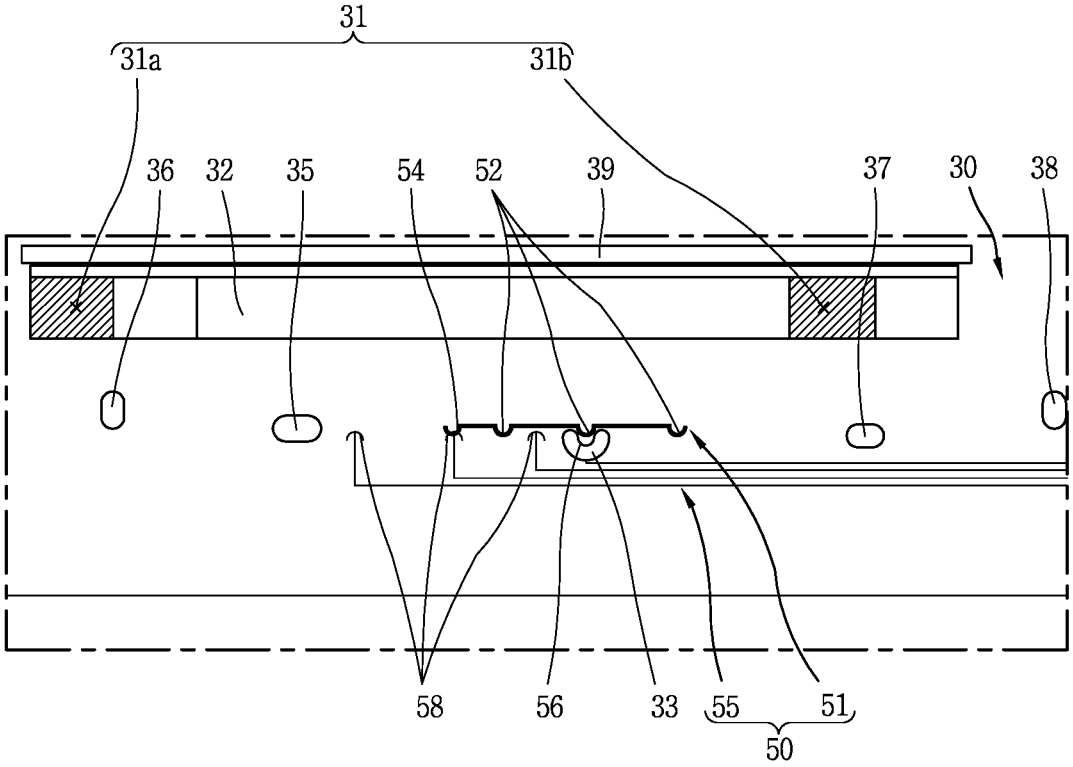
FIG. 11B is a conceptual view illustrating an operation of a sensing unit in a half-open state of the cold air discharge opening according to the present disclosure.
Figure 11C:
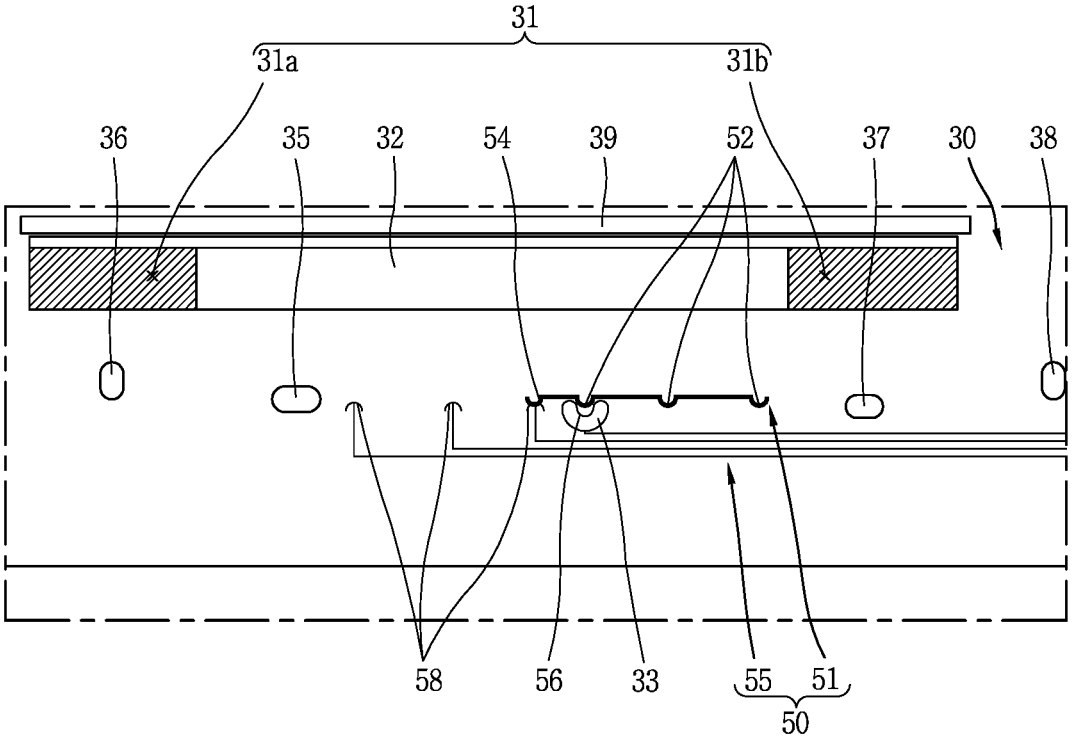
FIG. 11C is a conceptual view illustrating an operation of a sensing unit in a fully-open state of the cold air discharge opening according to the present disclosure.

FIG. 11A is a conceptual view illustrating an operation of the sensing unit 50 when the cold air discharge opening 31 is closed according to an embodiment of the present disclosure. FIG. 11B is a conceptual view illustrating an operation of the sensing unit 50 when the cold air discharge opening 31 is half-open according to the present invention. FIG. 11C is a conceptual view illustrating an operation of the sensing unit 50 when the cold air discharge opening 31 is fully opened according to the present invention.

Hereinafter, the sensing unit 50 that operates according to the opening and closing amount of the cold air discharge opening 31 is described, with reference to FIGS. 7, 8, 9, 10, 11A, 11B and 11C.

FIGS. 11A, 11B, and 11C do not directly illustrate the shape of the knob 40; however, the knob 40 coupled to the conductive member 51 should be understood with reference to FIGS. 7, 8, 9, and 10.

FIG. 11A illustrates the operation of the sensing unit 50 when the cold air discharge opening 31 is closed by the knob 40, such as illustrated in FIGS. 7 and 8. As illustrated, in this state, the rightmost protruding portion 52 of the plurality of protruding portions 52 is connected to the accommodating terminal 56. Also, the contact portion 54 is connected to the leftmost connection terminal 58 of the plurality of connection terminals 58. Therefore, the accommodating terminal 56 is electrically connected with the leftmost connection terminal 58 of the plurality of connection terminals 58. In this instance, information related to the closed state of the cold air discharge opening 31 may be stored, such as relative position information related to the knob 40 with respect to the control case 30.

FIG. 11B illustrates the operation of the sensing unit 50 when the cold air discharge opening 31 is half-way opened by the knob 40. The opened area of the cold air discharge opening 31 is indicated as a shaded section in FIG. 11B. This indicates a state that the cold air discharge opening 31 is open by half in response to a relative movement of the knob 40 with respect to the control case 30. In this state, the middle protruding portion 52 of the plurality of protruding portions 52 is connected to the accommodating terminal 56. Also, the contact portion 54 is connected to the middle connection terminal 58 of the plurality of connection terminals 58. Therefore, the middle connection terminal 58 of the plurality of connection terminals 58 is electrically connected to the accommodating terminal 56. In this instance, the information related to the half-open state of the cold air discharge opening 31 may be stored in the refrigerator, such as the relative position information related to the knob 40 with respect to the control case 30.

FIG. 11C illustrates the operation of the sensing unit 50 when the cold air discharge opening 31 is fully open by the knob 40, such as illustrated in FIGS. 9 and 10. The area of the cold air discharge opening 31 is indicated as a shaded section. This indicates a state that the cold air discharge opening 31 is fully open in response to a relative movement of the knob 40 with respect to the control case 30. In this state, the leftmost protruding portion 52 of the plurality of protruding portions 52 is connected to the accommodating terminal 56. Also, the contact portion 54 is connected to the rightmost connection terminal 58 of the plurality of connection terminals 58. Therefore, the rightmost connection terminal 58 of the plurality of connection terminals 58 is electrically connected to the accommodating terminal 56 by the conductive member 51. In this instance, the information related to the open state of the cold air discharge opening 31 may be stored in the refrigerator, such as the relative position information related to the knob 40 with respect to the control case 30.

FIGS. 11A, 11B, and 11C illustrate the examples of the closed state, the half-open state, and the open state, respectively. However, it is understood that the present invention is not limited thereto. For example, the present invention may be configured such that the number of the protruding portion 52 and the number of the connection terminal 58 is variable. When the protruding portions 52 and the connection terminals 58 are provided more in number, the opening and closing amount of the cold air discharge opening 31 is adjusted in a manner of being segmented in more precision, such as ⅓, ¼ or ⅕, and related information can be provided to the user such that the opened and closed amount of the cold air discharge opening 31 may be monitored by the user.

Figure 12:
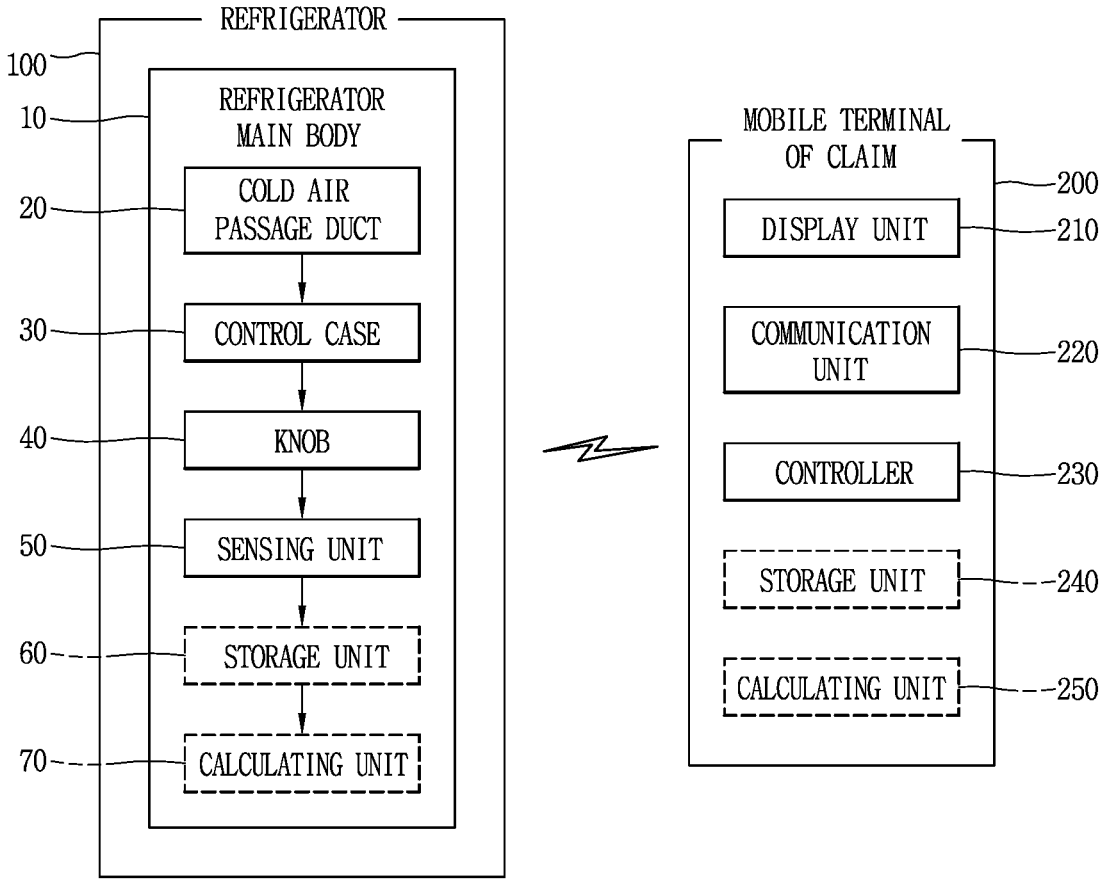
FIG. 12 is a block diagram illustrating a cold air flow rate (fluid) monitoring system of a refrigerator according to the present disclosure.

FIG. 12 is a block diagram illustrating a cold air flow rate (fluid) monitoring system for a refrigerator according to an embodiment of the present disclosure.

As shown, the cold air flow rate monitoring system may include a refrigerator 100, and a mobile terminal 200.

The mobile terminal 200 may include a display unit 210, a communication unit 220, and a controller 230.

The display unit 210 may display relative position information on a knob 40 with respect to a control case 30, reference position information on the knob 40 with respect to the control case 30, adjusted position information on the knob 40 with respect to the control case 30, and the like. The user may thus monitor a cold air flow rate by obtaining those information through the display unit 210, to adjust the opening and closing amount of the cold air discharge opening 31.

The communication unit 220 may perform wireless communication with the refrigerator 100. More particularly, the communication unit 220 may receive relative position information on the knob 40 with respect to the control case 30 from the refrigerator 100 through wireless communication with the refrigerator 100.

The wireless communication may be Wireless Fidelity (Wi-Fi) communication or Near Field Communication (NFC), but is not limited thereto. The Wi-Fi disclosed herein is understood as an NFC network using electric waves or infrared transmission method. It is understood that the NFC, which is a wireless communication technology performed within a short distance, may include a Bluetooth communication method.

The controller 230 may be electrically connected to the display unit 210 and the communication unit 220 to output the relative position information on the knob 40. The controller 230 may control the display unit 210 to output the reference position information on the knob 40 and the adjusted position information on the knob 40 which is explained later.

The mobile terminal 200 may include a storage unit 240 and a calculating unit 250. The storage unit 240 may store the reference position information on the knob 40 with respect to the control case 30. The reference position information on the knob 40 with respect to the control case 30 may be set based on external temperature and internal temperature of the refrigerating chamber, an example of which is described below with reference to FIG. 14.

The calculating unit 250 may receive the reference position information on the knob 40 from the storage unit 240, and calculate the adjusted position information on the knob 40 based on the received reference position information on the knob 40 and the relative position information on the knob 40. The adjusted position information on the knob 40 may be understood as an adjustment amount of the knob 40 for adjusting the position of the knob to match the reference position.

The configuration including the storage unit and the calculating unit may be provided in the mobile terminal 200, or as described below, may alternatively be provided in the refrigerator 100.

The refrigerator 100 may include a storage unit 60 and a calculating unit 70. The storage unit 60 may store the reference position information on the knob 40 with respect to the control case 30. The reference position information on the knob 40 with respect to the control case 30 may be set based on external temperature and internal temperature of the refrigerating chamber, which is described in detail later with reference to FIG. 14.

The calculating unit 70 may receive the reference position information on the knob 40 from the storage unit 60, and calculate the adjusted position information on the knob 40 based on the received reference position information on the knob 40 and the relative position information on the knob 40.

When the storage unit and the calculating unit are provided in the mobile terminal 200, the relative position information on the knob 40 sensed in the refrigerator 100 is transmitted to the mobile terminal 200 through wireless communication, and the adjusted position information on the knob 40 is calculated in the mobile terminal 200.

As aforementioned, the configuration including the storage unit and the calculating unit may alternatively be provided in the refrigerator 100. In this configuration, the calculation of the adjusted position information on the knob 40 is carried out in the refrigerator 100 and the relative position information, the reference position information and the adjusted position information related to the knob 40 are transmitted from the refrigerator 100 to the mobile terminal 200 through the wireless communication.

Figure 13:
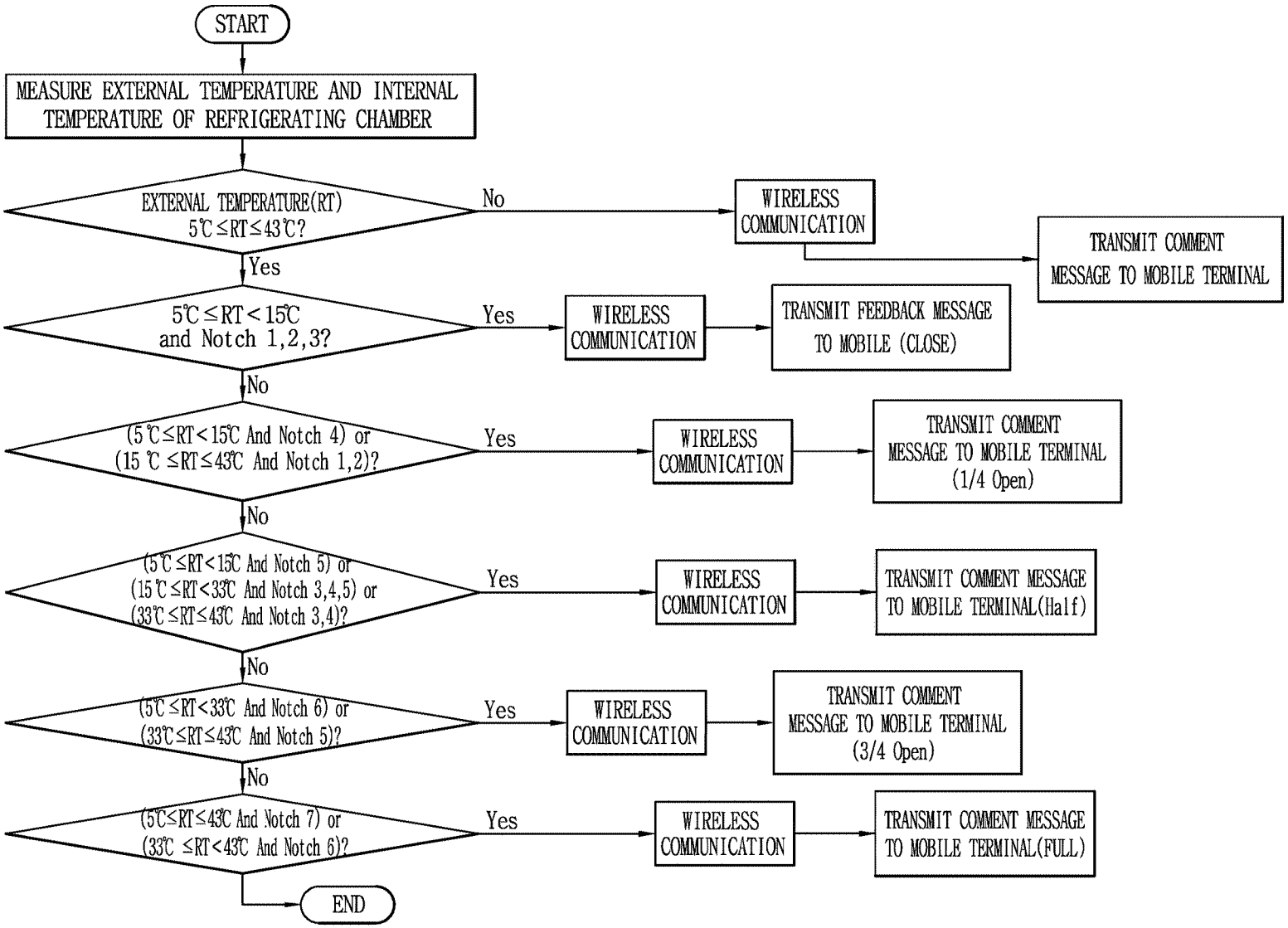
FIG. 13 is a flowchart illustrating one example of providing information to a mobile terminal by the cold air flow rate monitoring system of the refrigerator according to the present disclosure.

FIG. 13 is a flowchart illustrating a non-limiting example of providing information to the mobile terminal 200 by the cold air flow rate monitoring system for the refrigerator 100 according to an embodiment of the present disclosure. FIG. 14 is a table showing reference position information related to the knob 40 with respect to the control case 30 based on external temperature and internal temperature of the refrigerating chamber.

The monitoring (described in more detail below) may include considering internal and external temperatures of the refrigerating chamber. For example, when the measured external temperature is not in the range of 5° C. to 43° C., a message indicating that the monitoring is not properly performed is transmitted to the mobile terminal 200 through wireless communication.

For example, when the external temperature is in the range of 5° C. to 15° C. and a notch value is 1, 2 or 3, a message including information indicating that the cold air discharge opening 31 should be closed is transmitted to the mobile terminal 200 through the wireless communication. Although not illustrated, current relative position information and adjusted position information related to the knob 40 may be transmitted to the mobile terminal.

In FIGS. 13 and 14, Notches 1 to 7 refer to temperatures of the refrigerating chamber from 1° C. to 7° C., respectively. RT10, RT25 and RT43 refer to external temperatures of 10° C., 25° C. and 43° C., respectively. When, for example, when the external temperature is in the range of 5° C. to 15° C. and the notch value is 4 or when the external temperature is in the range of 15° C. to 43° C. and the notch value is 1 or 2, a message including information indicating that the cold air discharge opening 31 should be open by ¼ is transmitted to the mobile terminal 200 through the wireless communication. Although not illustrated, current relative position information and adjusted position information related to the knob 40 may also be transmitted to the mobile terminal.

When, for example, the external temperature is in the range of 5° C. to 15° C. and the notch value is 5, when the external temperature is in the range of 5° C. to 33° C. and the notch value is 3, 4 or 5, or when the external temperature is in the range of 33° C. to 43° C. and the notch value is 3 or 4, a message including information indicating that the cold air discharge opening 31 should be open by ½ is transmitted to the mobile terminal 200 through the wireless communication. Although not illustrated, current relative position information and adjusted position information related to the knob 40 may also be transmitted to the mobile terminal. When, for example, the external temperature is in the range of 5° C. to 33° C. and the notch value is 6 or when the external temperature is in the range of 33° C. to 43° C. and the notch value is 5, a message including information indicating that the cold air discharge opening 31 should be open by ¾ is transmitted to the mobile terminal 200 through the wireless communication. Although not illustrated, current relative position information and adjusted position information related to the knob 40 may also be transmitted to the mobile terminal.

When, for example, the external temperature is in the range of 5° C. to 43° C. and the notch value is 7 or when the external temperature is in the range of 33° C. to 43° C. and the notch value is 6, a message including information indicating that the cold air discharge opening 31 should be fully open is transmitted to the mobile terminal 200 through the wireless communication. Although not illustrated, current relative position information and adjusted position information related to the knob 40 may also be transmitted to the mobile terminal.

Thus, in the refrigerator according to the present disclosure, a pressing protrusion may be provided on a control case and a flow rate adjusting portion pressed by the pressing protrusion may be provided on a knob, which allows for adjusting an opening and closing amount of the cold air discharge opening in a manual manner.

Also, in the refrigerator according to the present disclosure, in replacement of a damper which is controlled electrically, a knob coupling portion may be formed on the cold air discharge opening and a stopping portion may be slidably coupled to the knob coupling portion, thereby enabling a manual manipulation of the knob. This allows for reduced power consumption and material costs, as well as ability to implement a more specific user-desired temperature.

Also, in the refrigerator according to the present disclosure, a sensing unit that includes a conductive member, and a circuit portion constructing different circuits according to a moved degree of the knob may be employed to provide the user with information related to the opening and closing amount of the cold air discharge opening.

Meanwhile, the refrigerator according to the present disclosure may implement a refrigerator system that calculates adjusted position information related to the knob based on reference position information and relative position information related to the knob for an external temperature and an internal temperature of a refrigerating chamber, and provide the calculated information to the user such that the user can monitor the opening and closing amount of the cold air discharge opening.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body having a refrigerating chamber therein;

a cold air passage duct disposed within the main body, the cold air passage duct including a cold air passage to discharge cold air into the refrigerating chamber;

a control case attached at the cold air passage duct, the control case including a cold air discharge opening;

a knob attached to the control case, the knob to reciprocally move in one direction to open and close at least part of the cold air discharge opening by said reciprocally move; and a sensing unit to sense a relative position of the knob with respect to the control case to acquire information related to an amount that the cold air discharge opening is opened or closed, wherein the sensing unit comprises:

a conductive member extending in the one direction, the conductive member provided on the knob and made of a conductive material, and a circuit portion provided on the control case and electrically connected to a different point of the conductive member according to a moved degree of the knob, and wherein the conductive member comprises:

a plurality of protruding portions provided at one side of the knob and spaced apart from one another with a preset interval in the one direction; and a contact portion provided at another side of the knob, the contact portion being spaced apart by a preset interval from one of the protruding portions, whereby the plurality of protruding portions provide for the circuit portion to be electrically connected to the conductive member, wherein the knob comprises a flow rate adjusting portion to adjust an amount that the cold air discharge opening is opened or closed in response to being pressed by a pressing protrusion protruding below the cold air discharge opening of the control case, wherein the flow rate adjusting portion comprises a plurality of protrusions that are spaced apart from one another by a preset interval on a lower end portion of the knob, wherein the circuit portion comprises:

an accommodating terminal electrically connected to one of the protruding portions to accommodate the one protruding portion during a movement of the knob, and a plurality of connection terminals being spaced apart from one another with a preset interval in the one direction, the plurality of connection terminals to connect with the contact portion, and wherein the plurality of protruding portions cover the plurality of protrusions, and the plurality of protruding portions are pressed by the pressing protrusion to be stably electrically connected to the accommodation terminal.

2. The refrigerator of claim 1, wherein the connection terminals electrically have the same polarity, and the accommodating terminal has an opposite polarity to the polarity of the connection terminals.

3. The refrigerator of claim 1, wherein the pressing protrusion protruding below the cold air discharge opening is disposed toward the cold air passage duct to press against the lower end portion of the knob, wherein the flow rate adjusting portion comprises:

a slot cut off in the one direction to enable an elastic transformation of the lower end portion of the knob when the protrusions are pressed by the pressing protrusion.

4. The refrigerator of claim 3, wherein the protrusions are covered with the protruding portions, and the accommodating terminal is disposed at one end of the pressing protrusion.

5. The refrigerator of claim 1, wherein the pressing protrusion protruding below the cold air discharge opening toward the cold air passage duct, to press against the lower end portion of the knob, and wherein the control case comprises:

a first protruding portion provided below a first side of the cold air discharge opening and protruding toward the cold air passage duct, whereby the first protruding portion contacts the lower end of the knob to limit a downward movement of the knob and guide a lateral movement of the knob; and a second protruding portion provided at one side of the pressing protrusion and protruding toward the cold air passage duct to limit the lateral movement of the knob, the second protruding portion being positioned such that the first protruding portion is disposed between the pressing protrusion and the second protruding portion.

6. The refrigerator of claim 5, wherein the knob comprises:

a first movement limit end portion provided at the lower end portion of the knob, whereby the first movement limit end portion contacts the first protruding portion to limit the downward movement of the knob and guide the lateral movement of the knob; and a second movement limit end portion formed at a lower end portion of a first side of the knob, whereby the second movement limit end portion is connected to the first movement limit end portion, and stopped by the second protruding portion to limit a movement of the knob in one side direction.

7. The refrigerator of claim 6, wherein the control case further comprises:

a third protruding portion provided below the cold air discharge opening and protruding toward the cold air passage duct, whereby the third protruding portion contacts at least part of the knob to limit the downward movement of the knob and guide the lateral movement of the knob; and a fourth protruding portion protruding toward the cold air passage duct to limit the lateral movement of the knob, the fourth protruding portion being positioned such that the third protruding portion is disposed between the pressing protrusion and the fourth protruding portion.

8. The refrigerator of claim 7, wherein the knob further comprises:

a third movement limit end portion formed at a lower end portion of a second side of the knob, whereby the third movement limit end portion is stopped by the third protruding portion to limit the downward movement of the knob and guide the lateral movement of the knob; and a fourth movement limit end portion provided at the second side of the knob, whereby the fourth movement limit end portion is connected to the third movement limit end portion and stopped by the fourth protruding portion to limit a movement of the knob in another one side direction.

9. The refrigerator of claim 1, wherein the control case further comprises a knob coupling portion formed between a first and a second side of the cold air discharge opening, the knob coupling portion being spaced apart from an upper portion of the cold air discharge opening by a predetermined distance, whereby the knob is slidably coupled to the control case.

10. The refrigerator of claim 9, wherein the knob further comprises a stopping portion, the stopping portion being an upper end portion of the knob that is bent toward the knob coupling portion, whereby the knob is slidably coupled to the knob coupling portion.

11. The refrigerator of claim 10, wherein the knob further comprises a cut portion, the cut portion being formed by cutting off at least part of an upper portion of the knob, whereby the cut portion is communicably coupled with the cold air discharge opening such that the cold air is discharged by opening at least part of the cold air discharge opening, wherein the cold air discharge opening is disposed at each of both sides of the knob coupling portion, and the cold air discharge openings are configured to discharge the cold air therethrough such that both sides of the cold air discharge opening are configured to communicating with the cut portion.

12. The refrigerator of claim 10, wherein the first and second cold air discharge openings have the same area in a state of being opened and closed by the knob thereby allowing cold air to be uniformly supplied into the refrigerating chamber through the first and second cold air discharge openings.

* * * * *